US011084640B2

(12) United States Patent
Kooc et al.

(10) Patent No.: US 11,084,640 B2
(45) Date of Patent: Aug. 10, 2021

(54) PRODUCT PACKAGE, BLISTER, CARRIER AND BLANK THEREFOR

(71) Applicant: WestRock MWV, LLC, Atlanta, GA (US)

(72) Inventors: Linh L. Kooc, Richmond, VA (US); Cullen B. Rosenbrien, Richmond, VA (US); Matthew E. Zacherle, Chesterfield, VA (US)

(73) Assignee: WESTROCK MWV, LLC, Atlanta, GA (US)

( * ) Notice: Subject to any disclaimer, the term of this patent is extended or adjusted under 35 U.S.C. 154(b) by 0 days.

(21) Appl. No.: 16/671,453

(22) Filed: Nov. 1, 2019

(65) Prior Publication Data

US 2020/0140170 A1 May 7, 2020

Related U.S. Application Data

(60) Provisional application No. 62/755,612, filed on Nov. 5, 2018.

(51) Int. Cl.
*B65D 73/00* (2006.01)

(52) U.S. Cl.
CPC ..... *B65D 73/0085* (2013.01)

(58) Field of Classification Search
CPC ..... B65D 73/0064; B65D 73/0085; B65D 73/0057; B65D 73/0042; B65D 73/0092; B65D 73/0078
USPC ..... 206/476, 308, 779, 462, 471, 461, 495
See application file for complete search history.

(56) References Cited

U.S. PATENT DOCUMENTS

| | | | | |
|---|---|---|---|---|
| 3,155,232 A * | 11/1964 | Leone | B65D 73/0085 206/476 |
| 6,401,921 B1 * | 6/2002 | Usami | B65D 73/0014 206/349 |
| 7,021,458 B2 * | 4/2006 | Cummings | B65D 71/22 206/462 |
| 2016/0229612 A1 * | 8/2016 | Bailey | B65D 73/0092 |

* cited by examiner

*Primary Examiner* — Steven A. Reynolds
(74) *Attorney, Agent, or Firm* — John B. Swingle; Neil G. Cohen

(57) ABSTRACT

A package for packaging an article provides a package including a display card and tape measure mounted thereto. The display card includes a front panel, a rear panel and a pair of easel panels. The pair of easel panels form part of a tubular structure of an easel stand upon with the package may rest. The tape measure may include a tape and a tang mounted to an end of the tape, with the tape partially extended from a housing such that the tang engages with the one of the easel panels such that the extended portion of the tape is displayed. Another aspect of the invention provides a blister for mounting an article to a carrier in the form of a display card. The blister functions as a receiver for receiving a portion of an article, such as a hook mounted to the article.

6 Claims, 7 Drawing Sheets

PRODUCT PACKAGE, BLISTER, CARRIER AND BLANK THEREFOR

REFERENCE TO RELATED APPLICATION

This application claims the benefit of priority under 35 U.S.C. § 119(e) of U.S. Provisional Patent Application Ser. No. 62/755,612 filed on Nov. 5, 2018, which is hereby incorporated by reference in its entirety.

TECHNICAL FIELD

The present invention relates to product packaging, carriers and to blanks for forming the same. More specifically, but not exclusively, the invention relates to a carrier providing a display card for mounting a product thereto, to a blank for forming the display card and to a blister for mounting a product to the display card.

BACKGROUND

In the field of packaging it is known to provide carriers for carrying articles or products. Carriers are well known in the art and are useful for display of product information to consumer, display of the articles in a retail environment and enabling consumers to transport, store and access the product.

Manufacturers and retailers of consumer goods, such as household items, tools, pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates.

Some packages may comprise a paperboard card and a polymeric blister. Often the paperboard card may be a planar or flat construction. Such a construction may not stand up readily, or may lack visual interest. It would be advantageous to have a package that provides a feature to help the package stand upright, or form a more interesting, non-planar structure.

It is desirable to expose some or all of the product while on display to a consumer to allow inspection of the product and it is desirable to maximise the visual or aesthetic impact the package has upon the consumer.

The present invention seeks to provide an improvement in packages, typically formed from paperboard or the like.

SUMMARY

A first aspect of the present disclosure provides a package comprising a display card and tape measure mounted thereto. The display card comprises a front panel and a rear panel. The front panel is hingedly connected to the rear panel by a pair of inter-connecting panels. A first panel is hingedly connected at one end to the front panel and is struck, at least in part, from the front panel. A second panel is hingedly connected to a second opposing end of the first panel. The second panel is hingedly connected to the rear panel. The first and second panels form part of a tubular structure of a stand. The tape measure may comprise a tape and a tang mounted to an end of the tape. The tape may be partially extended from a housing of the tape measure such that the tang engages with the second panel.

Optionally, the display card comprises a closure panel for at least partially closing an upper end of the tubular structure. The closure panel may be hingedly connected to an upper edge of the second panel. The front panel may comprise a free edge portion forming a retainer. The closure panel is folded into engagement with the free edge portion and held in a folded condition by the retainer. The closure panel, the first panel and the second panel form a display easel upon which the partially extended tape portion is mounted.

A second aspect of the present disclosure provides a package comprising a display card and a product mounted thereto. The display card comprises a front panel and a rear panel. The front panel is hingedly connected to the rear panel by a pair of inter-connecting panels. A first panel is hingedly connected at one end to the front panel and is struck, at least in part, from the front panel. A second panel is hingedly connected to a second opposing end of the first panel. The second panel is hingedly connected to the rear panel. The first and second panels form part of a tubular structure of a stand. The product is mounted to the front panel such that a portion of the product and the stand provide a base upon which the package may rest.

A third aspect of the present disclosure provides a display card for mounting a product. The display card comprises a front panel and a rear panel. The front panel is hingedly connected to the rear panel by a pair of inter-connecting panels. A first panel is hingedly connected at one end to the front panel and is struck, at least in part, from the front panel. A second panel is hingedly connected to a second opposing end of the first panel. The second panel is hingedly connected to the rear panel. The first and second panels form part of a tubular structure of a stand.

Optionally, the display card comprises a closure panel for at least partially closing an upper end of the tubular structure. The closure panel is hingedly connected to an upper edge of the second panel. The front panel comprises a free edge portion for providing a retainer, the closure panel is folded into engagement with the free edge portion and is held in a folded condition by the retainer.

A fourth aspect of the present disclosure provides a blank for forming a display card. The blank comprises a front panel and a rear panel. The front panel is hingedly connected to the rear panel by a pair of easel panels. A first easel panel is hingedly connected at one end to the front panel and is struck, at least in part, from the front panel. A second easel panel is hingedly connected to a second opposing end of the first easel panel. The second easel panel is hingedly connected to the rear panel. The first and second easel panels are foldable to form part of a tubular structure of a stand.

Optionally, the blank comprises a closure panel for at least partially closing an upper end of the tubular structure. The closure panel is hingedly connected to an upper edge of the second easel panel. The front panel comprises a free edge portion providing a retainer. The closure panel is foldable into engagement with the free edge portion.

A fifth aspect of the present disclosure provides a blank for forming a carrier. The blank comprises a front panel and a rear panel for forming a display card. The front panel is hingedly connected to the rear panel by a pair of inter-connecting panels. A first panel is hingedly connected at one end to the front panel and is struck, at least in part, from the front panel. A second panel is hingedly connected to a second opposing end of the first panel. The second panel is hingedly connected to the rear panel. The first and second panels form part of a tubular structure of a stand in an assembled carrier.

Optionally, a closure panel is hingedly connected to an upper edge of the second panel. The closure panel is foldable into engagement with the front panel to form an easel upon which a portion of the product may be mounted.

Optionally, the front panel comprises a free edge portion for providing a retainer for engaging with the closure panel.

A sixth aspect of the present disclosure provides a blister for mounting an article to a carrier, the blister comprising a plurality of walls defining a cavity. The plurality of walls including a front wall, a pair of opposed side walls, a top wall and a bottom wall. One of the plurality of walls comprises a receiver for receiving a portion of an article. The blister comprises a flange, surrounding the cavity, for securing the blister to a carrier.

Optionally, the receiver comprises a cutaway provided in the top wall of the cavity.

Optionally, the receiver comprises a cutaway taken from the group comprising a slot, a slit, an aperture and a severance line.

Optionally, the blister further comprises a strengthening feature, the strengthening feature taken from the group comprising a plurality of ribs, ridges and corrugations.

Optionally, the strengthening feature extends across the front wall of the blister.

Optionally, the front wall comprises a detent for engaging with a portion of the article to secure the article to the blister.

A seventh aspect of the present disclosure provides a display card comprising a first panel and a blister mounted to the display card, the blister comprises a plurality of walls defining a cavity including a front wall, a pair of opposed side walls, a top wall and a bottom wall, wherein one of the plurality of walls comprises a receiver for receiving a portion of hook of an article to be displayed and wherein the blister comprises a flange for securing the blister to the first panel.

Optionally, the display card comprises a second panel, the second panel comprising an aperture wherein the cavity of the blister is received in the aperture, the blister arranged such that the flange is trapped between the first and second panel and the first and second panel are secured together in a face contacting relationship.

An eighth aspect of the invention provides a package comprising a display card to which a product comprising a hook is mounted, the display card having a first panel and a blister secured to the first panel, the blister comprising a plurality of walls defining a cavity including a front wall, a pair of opposed side walls, a top wall and a bottom wall, wherein one of the plurality of walls comprises a receiver in which the hook of the product is received and wherein the blister comprises a flange surrounding the cavity and secured to the first panel.

Optionally, the hook is a resiliently biased clip.

Optionally, the hook is a fold over clip.

Optionally, the product is a self-retracting tape measure.

A ninth aspect of the invention provides a package comprising a carrier and tape measure mounted thereto, the carrier comprising a vertical support, a first panel connected at one end to the vertical support, and a second panel connected to the first panel at a second opposing end thereof. The second panel is connected to the vertical support and the first and second panels form part of a structure of a stand. The tape measure comprises a tang mounted to the end of a tape, the tape being partially extended from a case of the tape measure such that the tang engages with the second panel.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blisters, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blisters, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
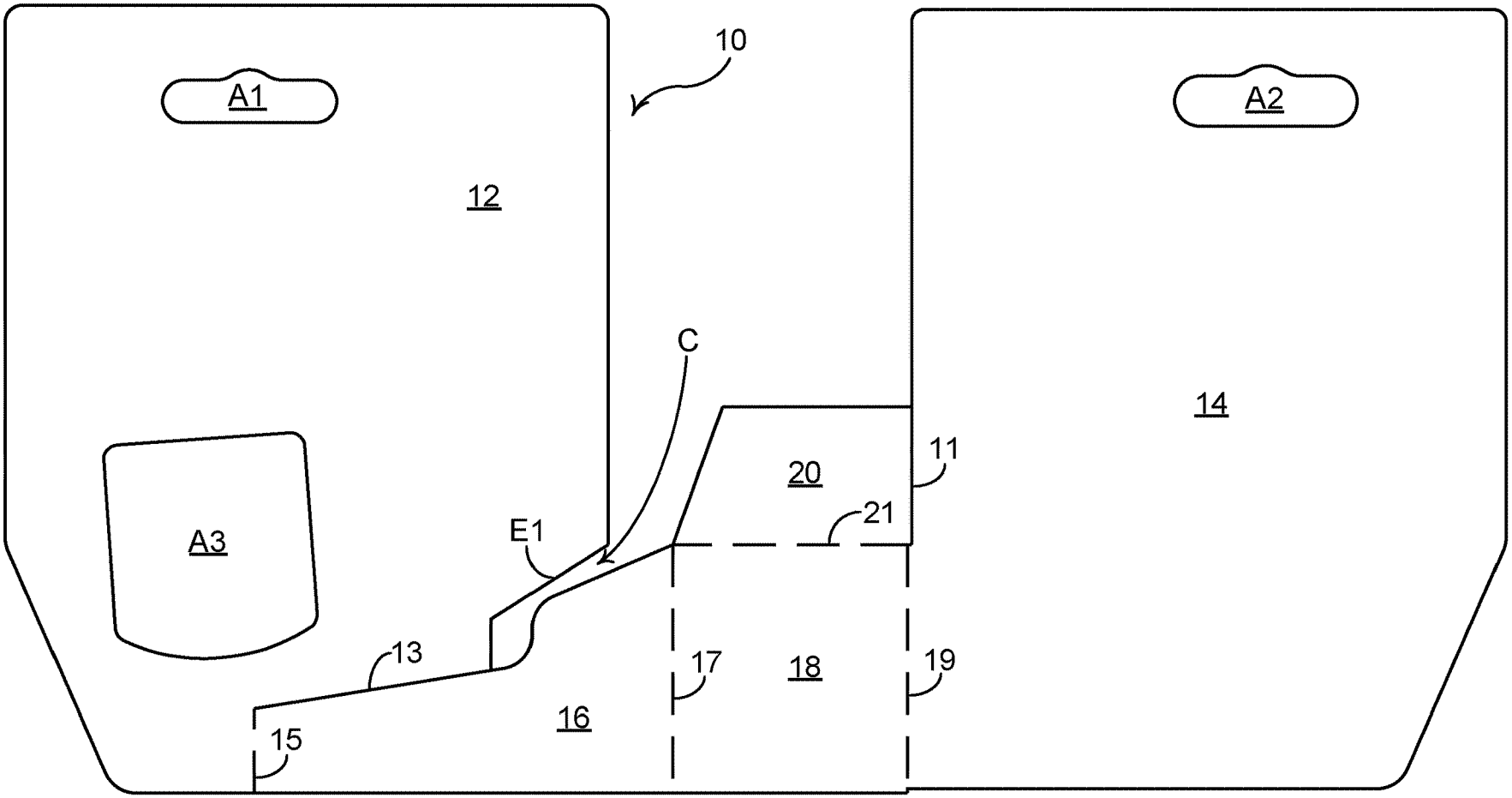
FIG. 1 is a plan view from above of a blank for forming a carrier according to a first embodiment.
Figure 2B:
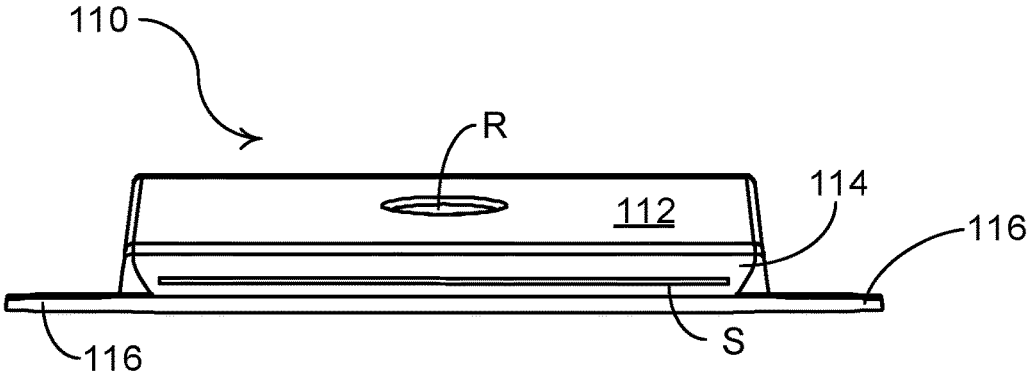
FIG. 2B is top view of the blister of FIG. 2A.
Figure 2A:
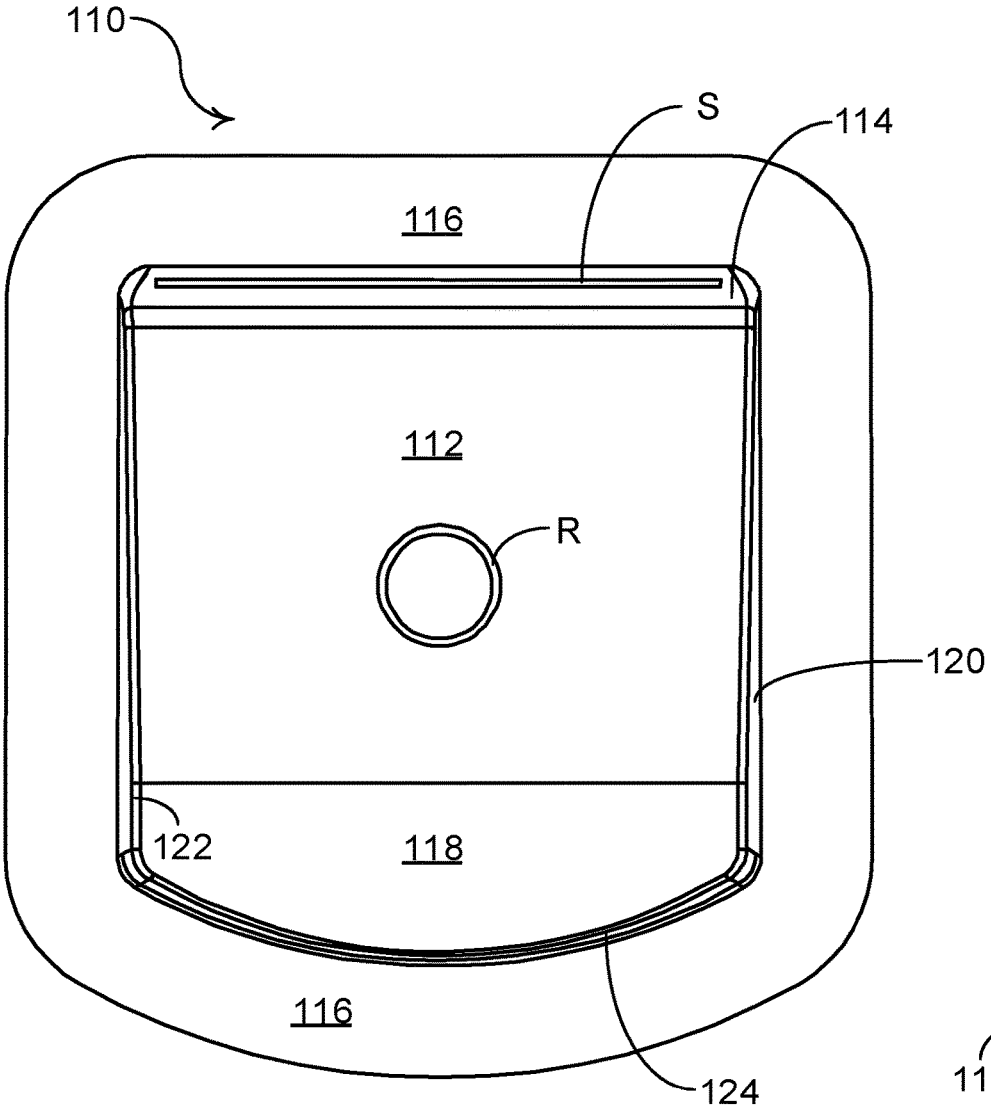
FIG. 2A is front view of a blister for use with the blank of FIG. 1.
Figure 2C:
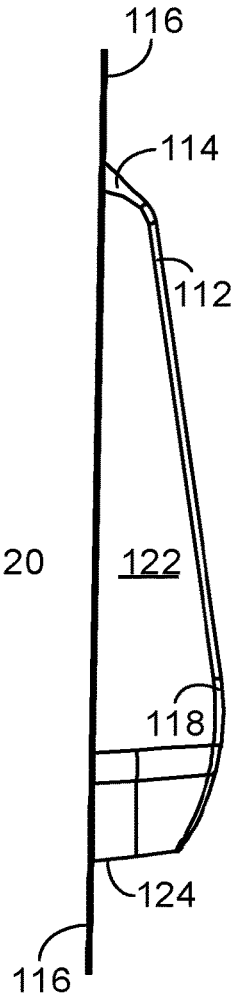
FIG. 2C is side view of the blister of FIG. 2A.
Figure 3:
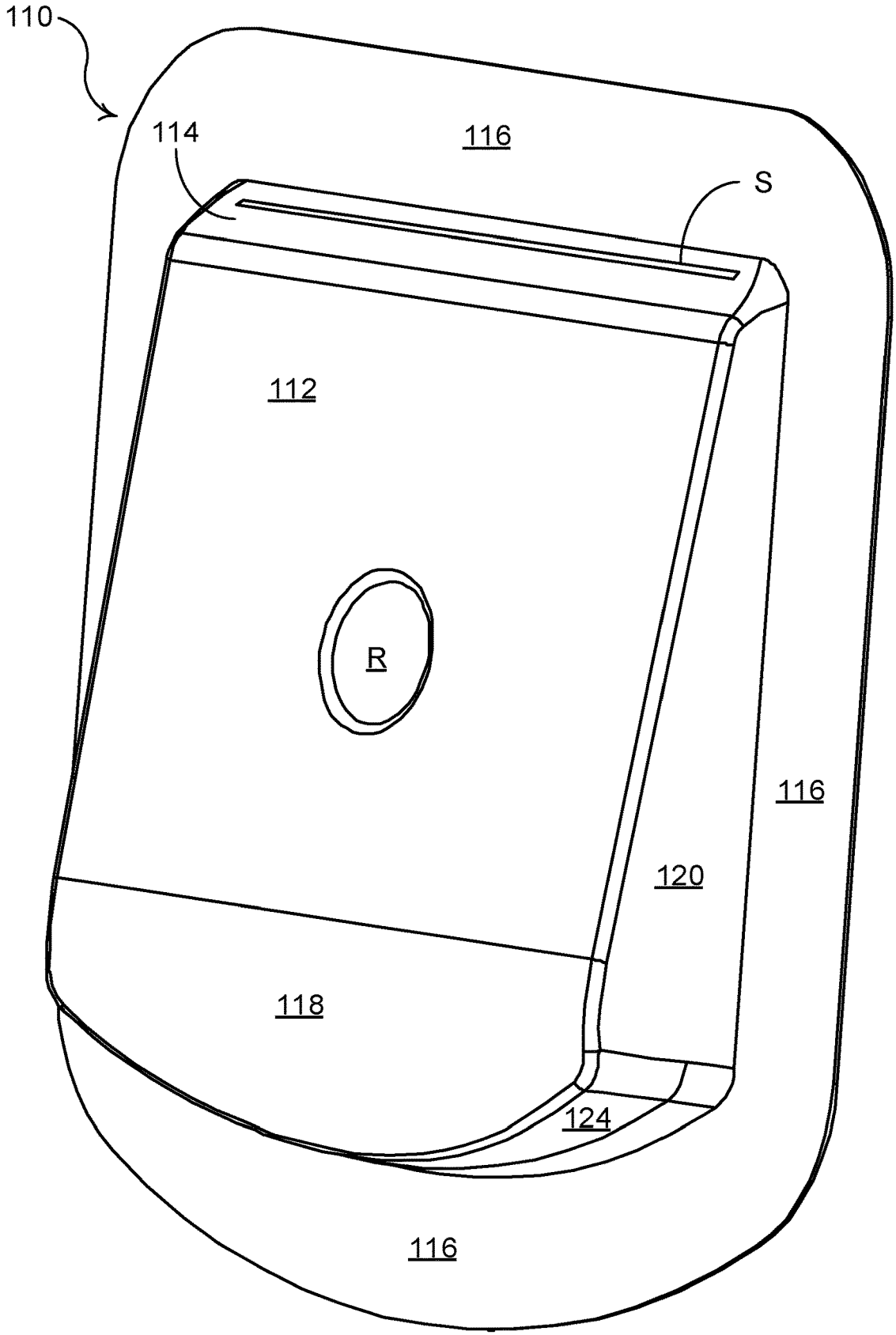
FIG. 3 is perspective view of the blister of FIG. 2A.
Figure 4:
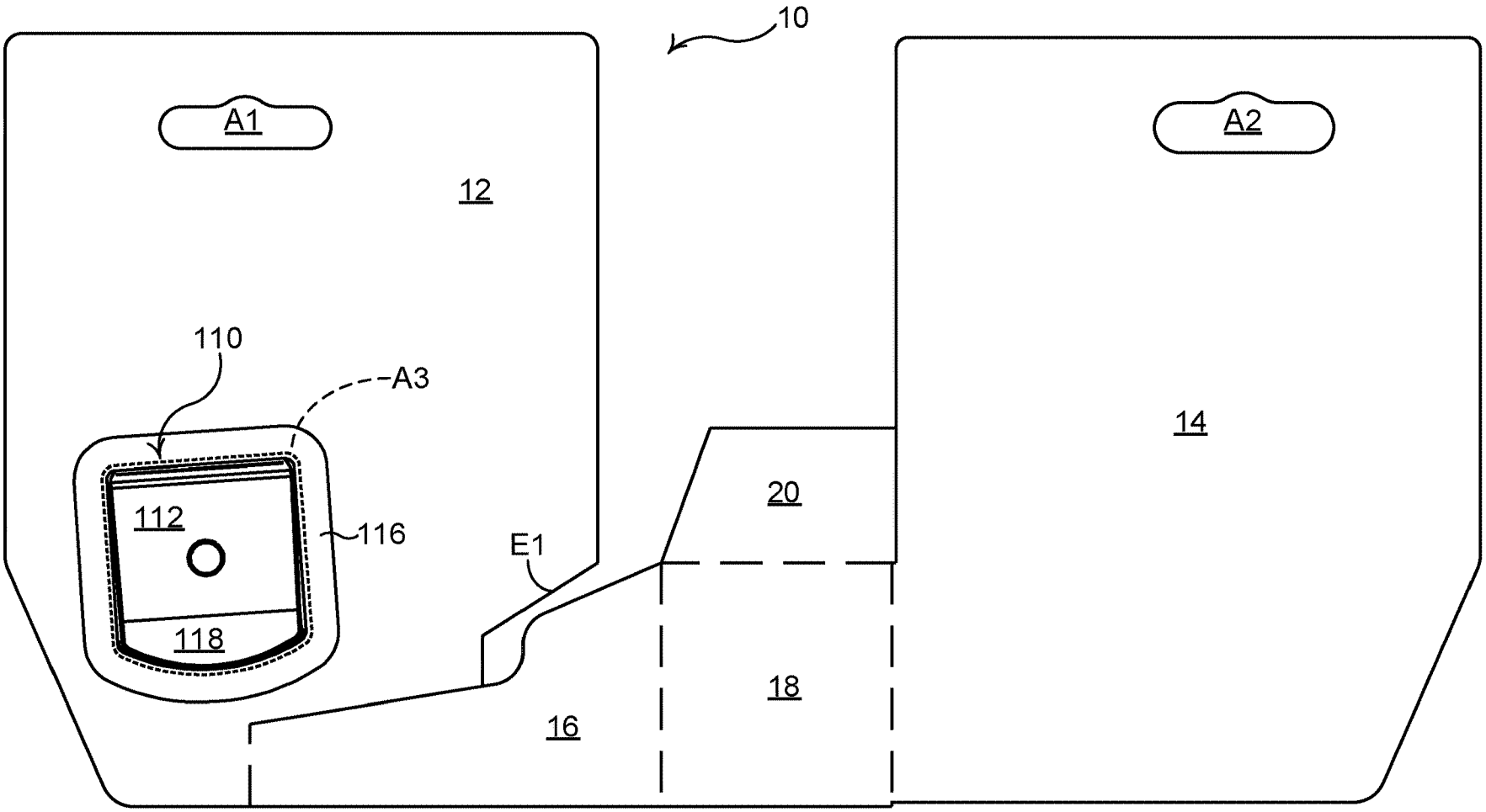
FIG. 4 illustrates a stage of construction of a carrier from the blank of FIG. 1 and the blister of FIG. 2A.
Figure 5:
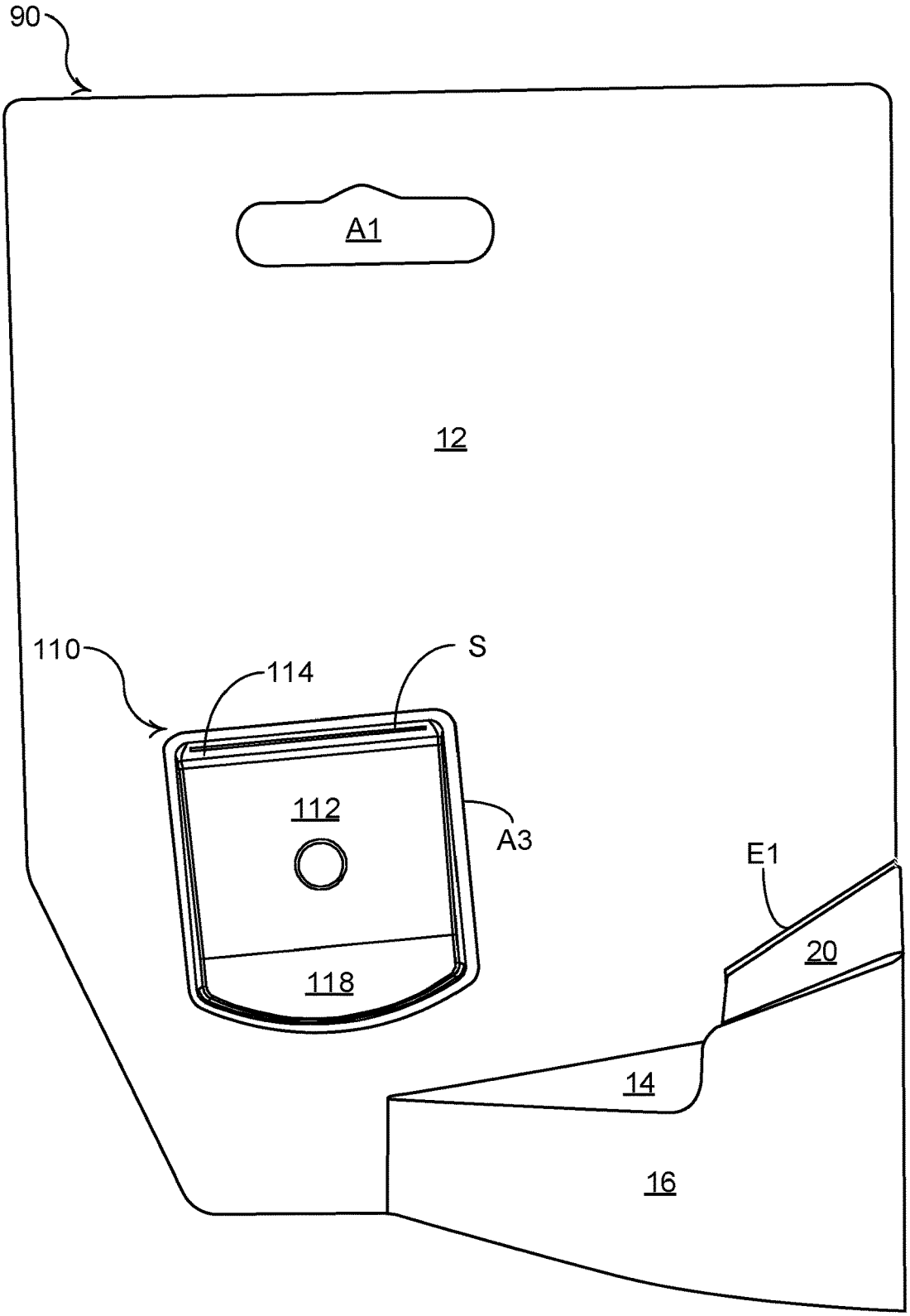
FIG. 5 is a perspective view of a carrier formed from the blank of FIG. 1 and the blister of FIG. 2A.

Referring to FIG. 1, there is shown a plan view of a blank 10 capable of forming a carrier 90, as shown in FIG. 5, for display of a primary product such as, but not limited to, a tape measure, hereinafter referred to as article B, as shown in FIG. 5.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carrier 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

Turning to FIG. 1, there is illustrated a blank 10 for forming a carrier 90 (see FIG. 5) according to a first embodiment. The blank 10 comprises a pair of main panels 12, 14, for forming a front panel 12 and a rear panel 14 of a display card structure.

The pair of main panels 12, 14 may be hingedly connected together by a pair of minor panels 16, 18 (also referred to as easel panels).

The minor panels 16, 18 interconnect the front panel 12 and the rear panel 14.

A first minor panel 16 is hingedly connected to the front panel 12 by a first hinged connection in the form of a fold line 15. A second minor panel 18 is hingedly connected, along a first edge, to the first minor panel 16 by a second hinged connection in the form of a fold line 17.

The second minor panel 18 is hingedly connected, along a second side edge, to the rear panel 18 by a third hinged connection in the form of a fold line 19. The second edge opposes the first edge.

A closure panel 20 is hingedly connected to the second minor panel 18, along a third edge thereof, by a fourth hinged connection in the form of a fold line 21. The third edge is disposed adjacent to each of the first and second edges. In normal use the third edge forms an upper edge of the second minor panel 18.

The first and second minor panels 16, 18 together with the front and rear panels 12, 14 form a tubular structure. The closure panel 20 at least partially closes one end of the tubular structure.

The front panel 12 comprises an optional first aperture A1. The rear panel 14 comprises an optional second aperture A2. Together the first and second apertures A1, A2 form an opening extending through the display card structure. The opening may provide a hanger device allowing a display apparatus (not shown) to pass therethrough such that the carrier 90 can be suspended from the display apparatus.

The front panel 12 comprises a cut-out in the form of a third aperture A3, the third aperture A3 is configured to receive a blister 110 as described below.

The first minor panel 16 may be struck, at least in part, from the front panel 12. That is to say that it is formed from a portion of the front panel 12 which would otherwise overlay the rear panel 14.

The first minor panel 16 is separated from the front panel 12 in part by a cut line 13 and in part by a cutaway C. The cutaway C defines an edge portion E1 of the front panel 12.

In the blank 10 the closure panel 20 is disposed adjacent to a side edge of the rear panel 14, the closure panel 20 is separated from the rear panel 14 by a cut line or severance line 11.

Referring now to FIGS. 2A, 2B, 2C and 3 there is shown a blister 110. The blister 110 takes the form of a shaped plastic part which defines a cavity or pocket and forms a product engagement means as explained herein. A flange 116 surrounds the cavity. The cavity comprises a plurality of walls including: an upper front wall 112, a lower front wall 118, a first side wall 120, a second side wall 122, a top wall 114 and a bottom wall 124. The upper front wall 112 and the lower front wall 118 together form a front wall 112/118.

The top wall 114 extends outwardly from the flange 116 to the upper front wall 112. The bottom wall 114 extends outwardly from the flange 116 to the lower front wall 118.

The first and second side walls 120, 122 extend outwardly from the flange 116 to the front wall 112/118.

The top wall 114 comprises a receiver. The receiver may be formed from a cutaway S such as but not limited to an aperture, slot, slit, cut line, severance line, frangible line or other weakened line.

The plurality of walls forming the cavity may be arranged such that front wall 112/118 is non-parallel, that is to say divergently arranged, with respect to the flange 116. The front wall 112/118 and the flange 116 diverge with respect to each other towards the bottom wall 124.

The blister 110 may comprise one or more strengthen features to improve the rigidity of the blister 110. For example, the front wall 112/118 may comprise one or more ridges, ribs or corrugations to improve its rigidity. The corrugations may extend across the front wall 112/118 substantially between the first and second side walls 120, 122. The corrugations may improve the rigidity of the blister 110 such that the cutaway S does not distort. This may enable the cutaway S to resist opening or spreading apart.

The blister 110 may comprise one or more detents R. In the illustrated embodiment the detent R takes the form of an embossment or debossment. The upper front wall 112 comprises an indented dome or dish which projects into the cavity defined by the plurality of walls.

The detent R may interact with a portion of the product P to retain or secure the product when mounted to the carrier 90. The detent R may prevent or at least mitigate against unintentional separation of the product from the carrier 90.

Turning to the construction of the carrier 90 as illustrated in FIG. 5, the carrier 90 can be formed by a series of sequential folding operations in a straight-line machine so that the carrier 90 is not required to be rotated or inverted to complete its construction. The folding process is not limited to that described below and may be altered according to particular manufacturing requirements.

The blister 110 is arranged such that the cavity is aligned with the third aperture A3. The blister 110 is brought into contact with an inner surface of the front panel 12. The cavity passes through the third aperture A3 such that the flange 116 is disposed in face contacting relationship with the inner surface of the front panel 12. The flange 116 is dimensioned and arranged to prevent the blister passing entirely through the front panel 12.

The blank 10 is folded to bring the rear panel 14 into overlying relationship with the front panel 12. The blank 10 is folded about the first, second and third fold lines 15, 17, 19.

The rear panel 14 is disposed substantially in registry with the front panel 12. The first and second apertures A1, A2 when present are disposed in registry with each other.

The rear panel 14 is secured to the front panel 12. In some embodiments this may be done by heat sealing or radio frequency (RF) sealing or welding.

In other embodiments glue or other adhesive treatment may be applied to the inner surface of the front or rear panels 12, 14 prior to bringing them into face contacting relationship to create a vertical support.

The carrier 90 formed is shown in FIG. 5, wherein the first and second minor panels 16, 18 are connected to the vertical support and form a substantially triangular tubular structure when viewed from above that projects outwardly from the vertical support 12, 14. The first and second minor panels 16, 18 facilitate or enable the carrier 90 to stand in an upright arrangement in which the front and rear panels 12, 14 are substantially vertical.

The closure panel 20 is folded about the fold line 21 to partially close and cover the triangular tubular structure formed by the first and second minor panels 16, 18. An upper surface of the closure panel 20 engages along a proximal side edge with the free edge portion E1 of the front panel 12. In this way the closure panel 20 is held or retained in a folded condition.

Figure 6:
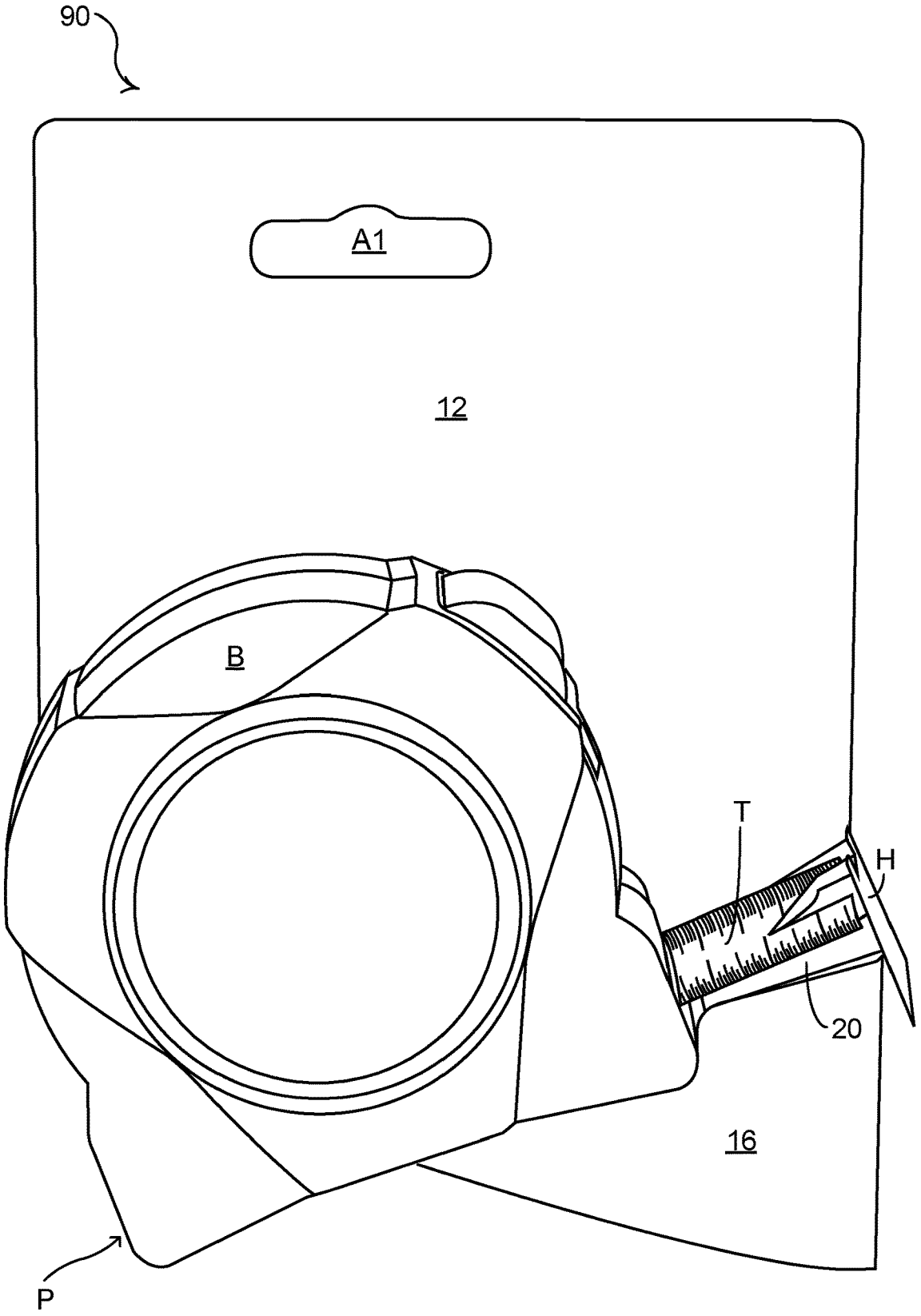
FIG. 6 is a perspective view of a package formed from the carrier of FIG. 5 which is loaded with a product.
Figure 7:
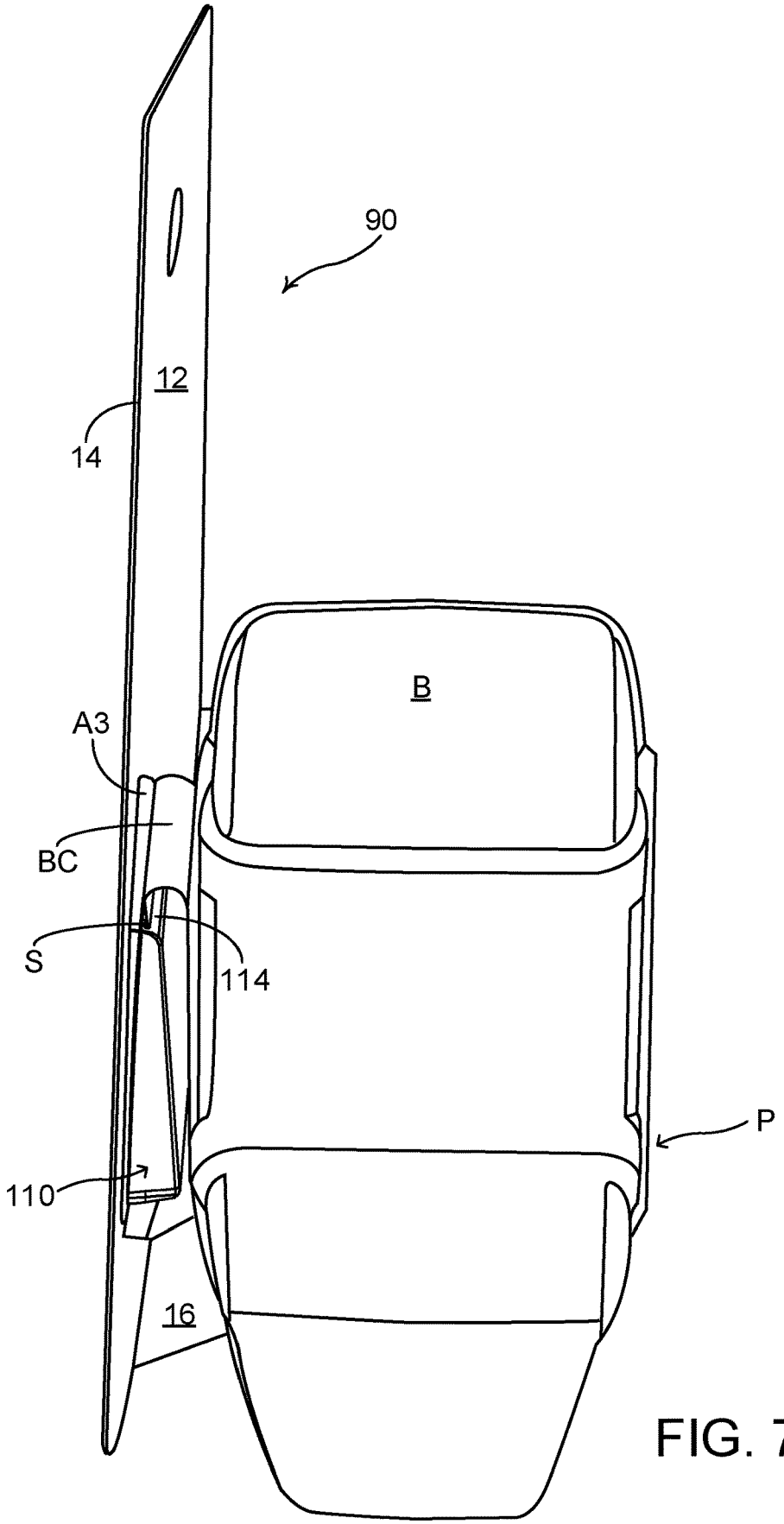
FIG. 7 is an alternative perspective view of the package of FIG. 6.

An article or product P is mounted to the carrier 90, as shown in FIGS. 6 and 7. The product P may comprise a hook or clip BC. In the illustrated the product P comprises a resiliently biased or sprung clip. The clip BC may allow a user to suspend the product P from a waist belt, tool pouch, pocket, tool bag or other suitable structure. The clip BC takes the form of a fold over clip and comprises a first, outer, portion and second, inner, portion. The second portion is mounted to the housing or case B of the product P.

The first portion of the clip BC is inserted through the receiver S in the blister 110. The blister thus functions as a product engagement means and the product P is thus hung or suspended from the carrier 90.

The first portion of the clip BC may comprise an opening, recess or other orifice. The detent R may interact with the opening. The opening may receive at least a portion of the detent so as to form a catch. In order to separate the product P from the carrier 90 the bias or spring force of the clip BC must be overcome to allow the first portion of the clip BC to disengage from the detent R.

When the first portion of the clip BC is inserted into the cavity of the blister 110 it must be deflected from a rest position, overcoming the bias or spring force, such that an end region the first portion of the clip BC passes over the detent R, when the detent R is aligned with the opening the first portion of the clip BC returns to, the rest position or at least is disposed close to the rest position.

The product P may be mounted to the carrier 90 such that a portion of the housing or case B of the product P cooperates with the carrier 90 such that it can be placed in a free-standing arrangement upon a surface.

In the illustrated embodiment the product P is a tape measure of the self-retracting type also known as a spring return pocket tape measure. The tape measure may comprise a floating tang or hook H at the end of the tape or ribbon T.

The first and second minor panels 16, 18 together with the closure panel 20 form an easel or support for displaying the tape T in a partially extended or deployed position. The tang H is hooked or engaged with the second minor panel 18, and may contact the edge between the closure panel 20 and second minor panel 18.

The first minor panel 16 may be tapered in shape so as to increase in height towards the second minor panel 18. This facilitates mounting of the product P at an inclined angle. The first minor panel 16 may be recessed or stepped in in shape. This may allow the tape T to be support by an upper region of the first minor panel 16, whereas the body B of the product is supported by a lower region of the first minor panel 16.

The present disclosure provides a package comprising a display card and tape measure mounted thereto. The display card comprises a front panel, a rear panel and a pair of easel panels. The pair of easel panels form part of a tubular structure of an easel stand upon with the package may rest. The tape measure may comprise a tape and a tang mounted to an end of the tape. The tape may be partially extended from a housing of the tape measure such that the tang engages with the one of the easel panels such that the extended portion of the tape is displayed upon the easel stand.

Another aspect of the disclosure provides a blister for mounting an article to a carrier in the form of a display card. The blister comprises a plurality of walls defining a cavity including a front wall, a pair of opposed side walls, and top and bottom walls. One of the plurality of walls comprises a receiver for receiving a portion of an article, such as a hook mounted to the article and comprising a flange for securing the blister to a display card.

It can be appreciated that various changes may be made within the scope of the present invention. For example, the size and shape of the panels and apertures may be adjusted to accommodate articles of differing size or shape. The illustrated embodiments have been described with reference to mounting a self-retracting tape measure, however it is envisaged that the blister 110 could be employed to mount different articles to a display card for example, but not limited to, other articles which comprise a hook or belt clip, such as a tool pouch, a belt pouch, a holster, a multi-tool, a two-way radio (walkie-talkie), a mobile telephone or other handheld electronic device or an accessory therefor and a knife sheath.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A package comprising a display card and tape measure mounted thereto, the display card comprising a front panel and a rear panel, the front panel being hingedly connected to the rear panel by a pair of inter-connecting panels including: a first panel hingedly connected at one end to the front panel and being struck at least in part from the front panel, and a second panel hingedly connected to the first panel at a second opposing end thereof; wherein the second panel is hingedly connected to the rear panel and the first and second panels form part of a tubular structure of a stand, and wherein the tape measure comprises a tang mounted to the end of a tape, the tape being partially extended from a case of the tape measure such that the tang engages with the second panel;

wherein the display card comprises a closure panel for at least partially closing an upper end of the tubular structure, the closure panel being hingedly connected to an upper edge of the second panel; wherein the front panel comprises a free edge portion for providing a retainer, the closure panel being folded into engagement with the free edge portion and held in a folded condition by the retainer, the closure panel, the first panel and the second panel forming a display easel upon which the partially extended tape portion is mounted.

2. A display card for mounting a product, the card comprising a front panel and a rear panel, the front and rear panels being disposed at least substantially in registry with one another in face-contacting relationship, the front panel being hingedly connected to the rear panel by a pair of inter-connecting panels including a first panel hingedly connected at one end to the front panel and being struck at least in part from the front panel, and a second panel hingedly connected to the first panel at a second opposing end thereof, the second panel being hingedly connected to the rear panel, the first and second panels forming part of a tubular structure of a stand;

wherein the card comprises a closure panel for at least partially closing an upper end of the tubular structure, the closure panel being hingedly connected to an upper edge of the second panel; wherein the front panel comprises a free edge portion for providing a retainer the closure panel folded into engagement with the free edge portion and held in a folded condition by the retainer.

3. A blank for forming a display card, the blank comprising a front panel and a rear panel, wherein said front and rear panels are configured to be disposed at least substantially in registry with one another in face-contacting relationship when the display card is formed, the front panel being hingedly connected to the rear panel by a pair of easel panels including: a first easel panel hingedly connected at one end to the front panel and being struck at least in part from the front panel, and a second easel panel hingedly connected to a second opposing end of the first easel panel; wherein the second easel panel is hingedly connected to the rear panel and wherein the first and second easel panels are foldable to form part of a tubular structure of a stand;

wherein the blank comprises a closure panel for at least partially closing an upper end of the tubular structure, the closure panel being hingedly connected to an upper edge of the second easel panel; wherein the front panel comprises a free edge portion providing a retainer, the closure panel being foldable into engagement with the free edge portion.

4. A package comprising a carrier and tape measure mounted thereto, the carrier comprising a vertical support; a first panel connected at one end to the vertical support, and a second panel connected to the first panel at a second opposing end thereof; wherein the second panel is connected to the vertical support and the first and second panels form part of a structure of a stand, and wherein the tape measure comprises a tang mounted to the end of a tape, the tape being partially extended from a case of the tape measure such that the tang engages with the second panel;

wherein the carrier comprises a closure panel for at least partially closing an upper end of the tubular structure, the closure panel being connected to an upper edge of the second panel; wherein the closure panel, the first panel and the second panel form a display easel upon which the partially extended tape portion is mounted.

5. A package according to claim 4 wherein the first panel is tapered in shape so as to increase in height towards the second panel whereby the partially extended tape portion is mounted at an inclined angle.

6. A package according to claim 4 wherein the tape measure further comprises a hook, and the carrier further comprising a product engagement means disposed on the vertical support for engaging the hook.

* * * * *